US006447199B1

(12) United States Patent
Berkowitz et al.

(10) Patent No.: US 6,447,199 B1
(45) Date of Patent: Sep. 10, 2002

(54) TABLE SPIDER COLUMN CONNECTION

(75) Inventors: Richard O. Berkowitz, St. Louis; Elliott W. Baum, Maryland Heights; Lucian N. Chirea, St. Louis; Robert J. Harrell, Warrenton, all of MO (US)

(73) Assignee: Berod Tableworks Ltd., St. Louis, MO (US)

( * ) Notice: Subject to any disclaimer, the term of this patent is extended or adjusted under 35 U.S.C. 154(b) by 0 days.

(21) Appl. No.: 09/579,667

(22) Filed: May 26, 2000

Related U.S. Application Data

(60) Provisional application No. 60/136,290, filed on May 27, 1999.

(51) Int. Cl.[7] ..... F16M 11/20

(52) U.S. Cl. ..... 403/356; 403/357; 403/373; 248/188.1

(58) Field of Search ..... 403/374.1, 373, 403/355, 356, 357, 358, 375, 362; 248/188.1; 108/150

(56) References Cited

U.S. PATENT DOCUMENTS 2,137,557 A * 11/1938 Ziganek ..... 403/356 X
2,807,485 A * 9/1957 Seibert ..... 403/356
2,996,302 A * 8/1961 Haviland et al. ..... 403/356 X
3,250,509 A * 5/1966 Molloy ..... 403/374.1 X
3,326,584 A * 6/1967 Tann ..... 403/356
3,327,656 A * 6/1967 Schwartz ..... 108/150
4,089,611 A * 5/1978 Riegler et al. ..... 403/358
4,643,105 A * 2/1987 Baum ..... 108/150
4,792,713 A * 12/1988 Bush ..... 403/357 X
4,807,838 A * 2/1989 Anderson ..... 248/188.1
4,990,021 A * 2/1991 Olgren ..... 403/355 X
5,026,010 A * 6/1991 Camarota ..... 248/188.1

* cited by examiner

*Primary Examiner*—Lynne H. Browne
*Assistant Examiner*—John Cottingham
(74) *Attorney, Agent, or Firm*—Paul M. Denk

(57) ABSTRACT

A sleeve type locking device, whether it be a hollow sleeve, a set screw configured device, secures a table base column to its associated spider, as within a counterbore, upon tightening of its supporting rod, during assembly and interconnection of such support to the underside of a table surface, during assembly.

6 Claims, 5 Drawing Sheets

TABLE SPIDER COLUMN CONNECTION

CROSS-REFERENCE TO RELATED APPLICATION

This application is a non-provisional patent application based upon provisional patent application having Ser. No. 60/136,290, filed on May 27, 1999, which is owned by the same inventors.

BACKGROUND OF THE INVENTION

This invention relates generally to means for interconnecting a column, to the underside of a table, to provide it with support, and more specifically pertains to the inner connection between a support rod, and a concentric column, that connect to a spider for securement to the underside of a table surface, and to provide some full support for the table during its erecting and usage.

There are a myriad of patents that have issued pertaining to table structures, means for providing their support, including the use of columns. At least three patents have issued to the inventor herein, and which have been assigned to a common assignee, and these patents include U.S. Pat. No. 4,643,105, pertaining to a Table Top Support; U.S. Pat. No. 5,121,697, relating to a Flip Top Table, in addition to U.S. Pat. No. 5,379,975, also pertaining to intermating table legs for providing support to a table top. As can be seen in the U.S. Pat. No. 4,643,105, a spider device is used for attachment to the under surface of the table top, and then cooperates with a column for providing support. In addition, in the U.S. Pat. No. 5,121,697, which shows a pivotal type of table top support, it can also be noted that a column, is concentrically arranged with a center supporting rod, that secures to the pivotal connecting means, and to the underside of the table top, as noted therein.

Thus, there are a variety of prior art that discloses various types of supports for tables, whether it be of the spider type connection, the solid rod support, or the column type support, used in combination with the rod, all to stably elevate the top of the table, when it is erected during usage.

SUMMARY OF THE INVENTION

The principal object of this invention is to provide for greater structural support between a column, and its interconnection with a spider, as the two are secured to the under surface of a table, in order to provide enhanced support.

This invention is designed to provide for an enhanced interconnection between the column that supports the table, and the interconnecting device such as the spider, that secures to the column, at its upper end, and to the underside of the table top surface, when the table is assembled. More specifically, since the column support normally includes an internal tensioned rod, that is concentric with the column, this invention further considers the structural components necessary to maintain proper concentric alignment between the rod, and its column, as both interconnect to the spider, particularly at the underside of the table top surface. In addition, it is just as likely that similar type of interconnection can be provided where the column and its rod secures to the base, for the assembled table.

More specifically, the upper and lower ends of the rod, that provides support, normally extend through apertures that are provided in the upper column, in addition to the lower support, and then are threaded into place by use of a flange nut, or other means of related fastening. The column, on the other hand, being of annular design, and having a circular upper and lower edge, require additional structure to provide for its proper spacement, to maintain its concentric relationship with the tensioning rod, and at the same time, add enhanced support and attractiveness to the table, once assembled. To achieve this, at least the upper spider, and perhaps the lower support, contains a counterboard concentric groove, concentric with respect to the rod, so that the upper edge of the column can insert into said groove, as it is secured into a tightened position, and tightly bound into its interconnection with the upper spider, by means of the tightening of the a connector upon the upper end of the rod, as it is threaded into position. Likewise, the support at the bottom of the table may also contain a concentric groove, facing upwardly, and into which the bottom edge of the column may insert, during its tightening into interconnection between the upper spider, and the lower support, in order to provide assembly of the table into its usable condition.

To hold the column, either at its upper or lower ends, into interconnection with the spider, or the upper surface of the lower support, a locking device is wedged between the upper, and even lower, edges of the column, as they insert into their respective associated grooves, in order to provide securement of these components together, and to keep them interlocked together, even though the table may be occasionally picked up, moved to another location, without the column, and lower support, disengaging therefrom, during movement. These locking devices may include a short length of sleeve, into which the upper edge of the column may imbed, during assembly, or the locking device may include a semi-circular part of a sleeve, that extends slightly into the counter board groove, and snugly binds against the upper outer edge surface of the column, during its insertion within the groove, and when it is tightly bound into connection, by securement of the threaded nut upon the upper end of the centered rod, and during its tightening. The same may occur at the bottom support, during its interconnection, when assembled. Furthermore, a spiral type of locking device, similar to a set screw, may be inserted into a slot adjacent the counter bore, into which the upper edge of the column is received, with the threads of the locking device extending slightly into the path of the groove, so as to bind against the outer surface, of the column, as it is squeezed into a tight relationship within the spider counter bore, as previously explained. Obviously, the counter bore is formed as a recess, for receiving the upper edge of the column, and provide for a positional locating of the column, relative to the spider, as it is bound into a tight relationship therein, by means of the center rod.

It is just as likely that the various recesses, into which the sleeves, semi-circular sleeves, or set screw type of locking device insert, may be located either externally of the column, in its alignment as provided within the spider, adjacent the counter bore, or it may be located at the inner edge of the column, at the opposite or inner side of the counter bore, to provide for a tightening of the column, within the spider, and its retention therein, after the rod and its flange nut are tightly secured in place, and placed under significant tension, so as to connect the table bottom support, its column and rod, tightly to the spider, and the combination to the underside of the table top surface, once the table is assembled. These are examples as to type of interconnection that can be made between these components, to provide for a very stable connection of the table components together, once assembled.

DESCRIPTION OF THE PREFERRED EMBODIMENT

Figure 1:
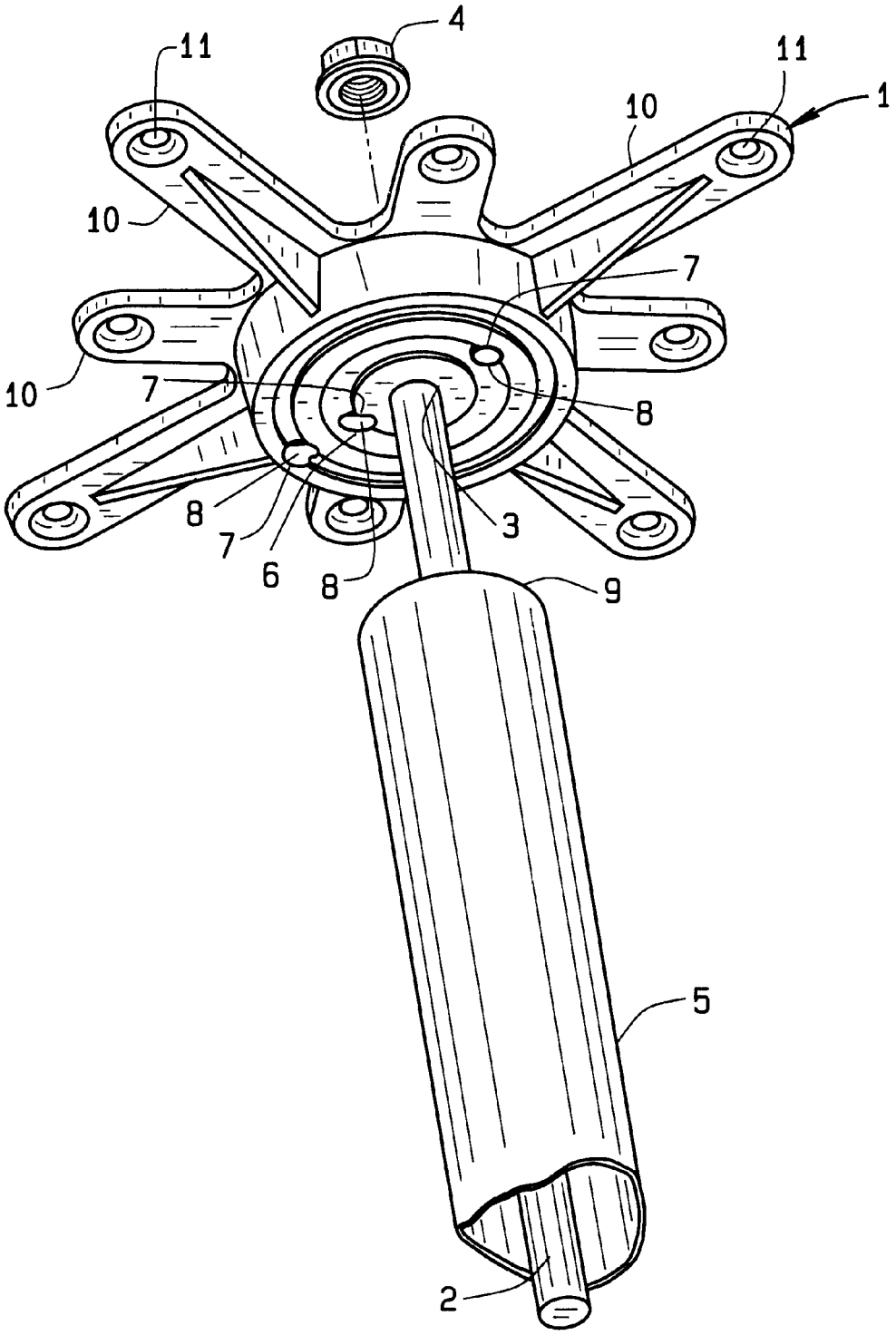
FIG. 1 is an isometric view of a table top spider, its tensioning rod, and the outer column that locates within the formed recess integrally provided at the underside of the shown spider.

In referring to the drawings, the invention generally is disclosed in FIG. 1, formed as a spider member 1, which has interconnected to it a rod 2 that extends through an aperture formed through the spider, as at 3, with the upper end of the rod being threaded, for interconnection with a flanged nut or other type of connector 4, as noted. A similar type of structured relationship may be contained at the bottom of the rod, where it connects with a floor support (not shown), for the table, once it is assembled. A column 5 is concentrically arranged around the rod 2, and inserts, during tightening and interconnection, within a counter bore or recess 6 formed in the underside of the spider 1, as can be seen. A series of recesses, as at 7, are disposed for accommodating a locking device, as at 8, and as the various connecting members, or nuts 4, are tightened upon their rods, by threadedly engaging thereon, they force the upper edge 9 of the column into their counter bore 6, and imbed or bind into the locking device 8, so as to not only affix the upper edge of the column, within its counter bore, and secure to the spider 1, but also prevent their inadvertent removable, in the event the nut and rod 2 should ever come loosened from their connection.

The spider as can be noted, includes the usual extending flanges, as at 10, and each has an aperture 11 counter bored therein, and through which a fastener, such as a screw, may insert, for threadedly engaging the spider permanently to the underside of a table top, as the table is assembled.

Figure 2:
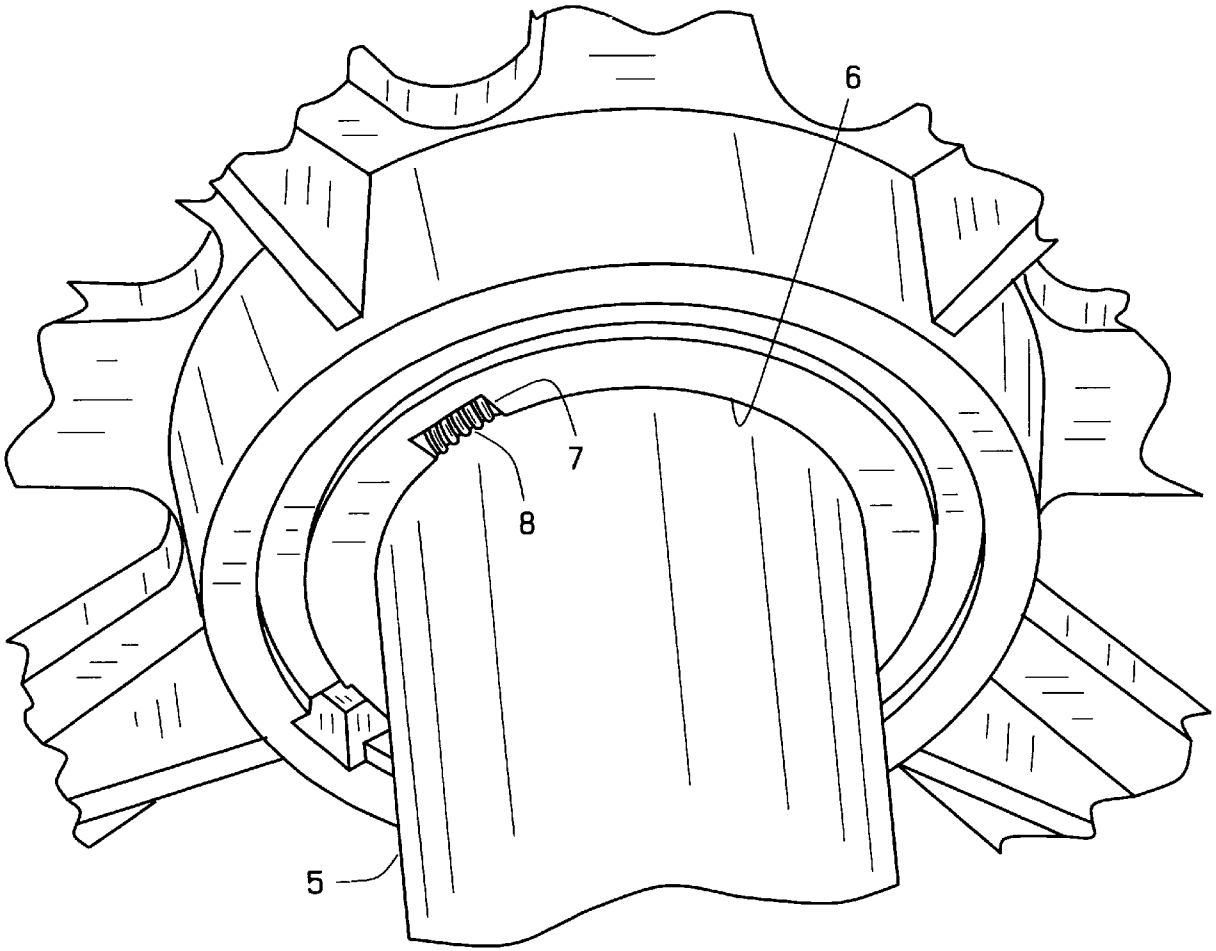
FIG. 2 is an enlarged and closeup view of the mounting of the column, within its associated counter bore, held in position by means of a locking device, to the underside of the spider that connects to the table.
Figure 3:
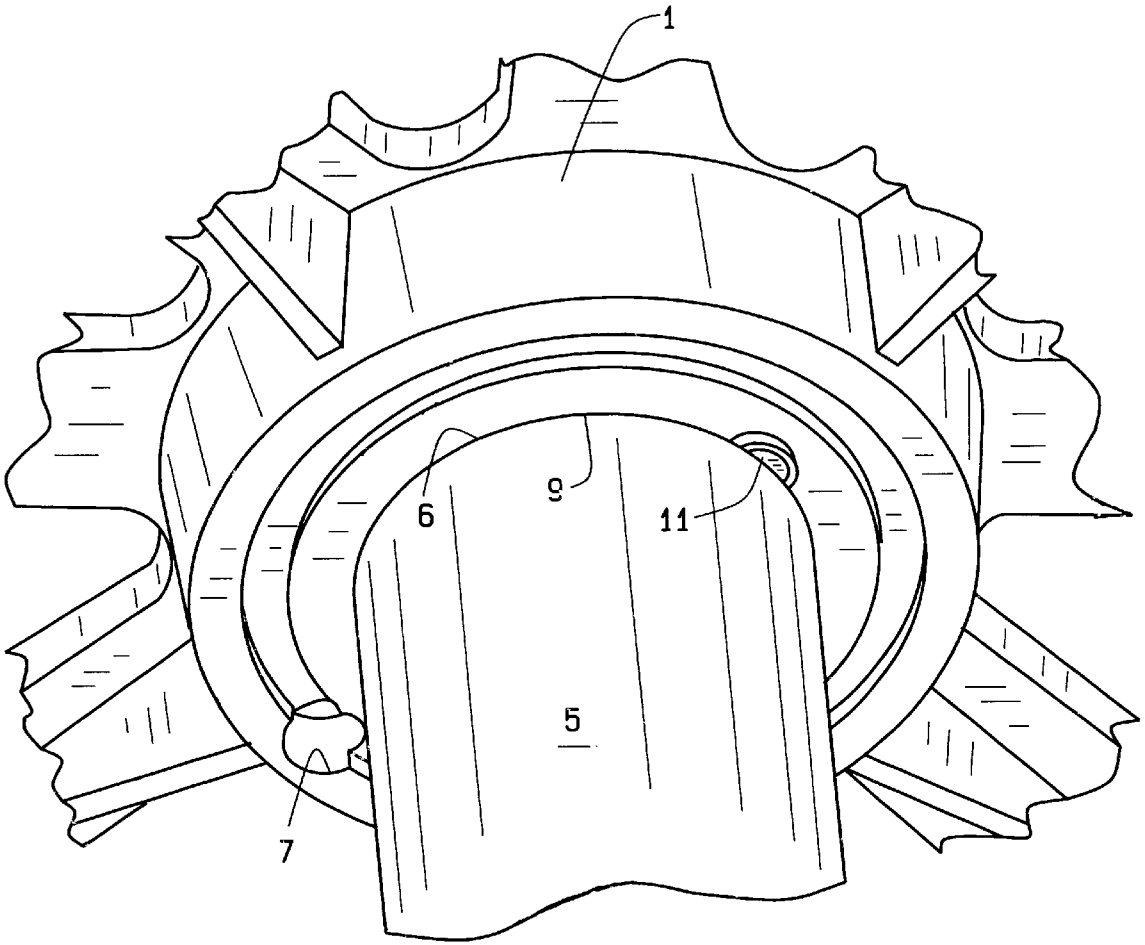
FIG. 3 is similar to the structure as shown in FIG. 2, but utilizes a semi-circular locking device for holding the column within its associated spider.
Figure 4:
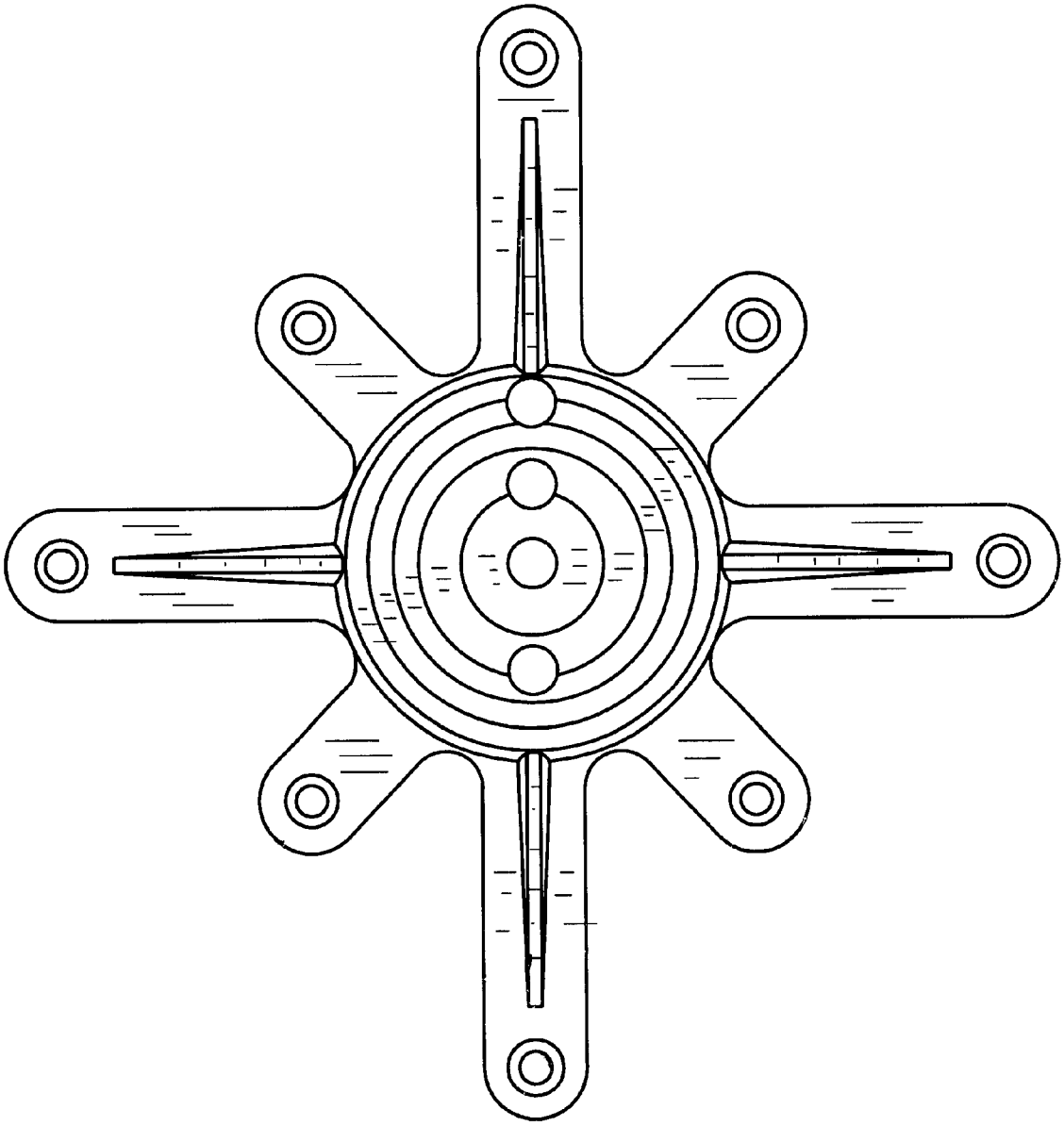
FIG. 4 shows an underside view of the table top spider, the location of the column counter bore, and the arrangement of the various recesses, adjacent the counter bore, and for use for securement of the column to the spider once assembled.
Figure 5:
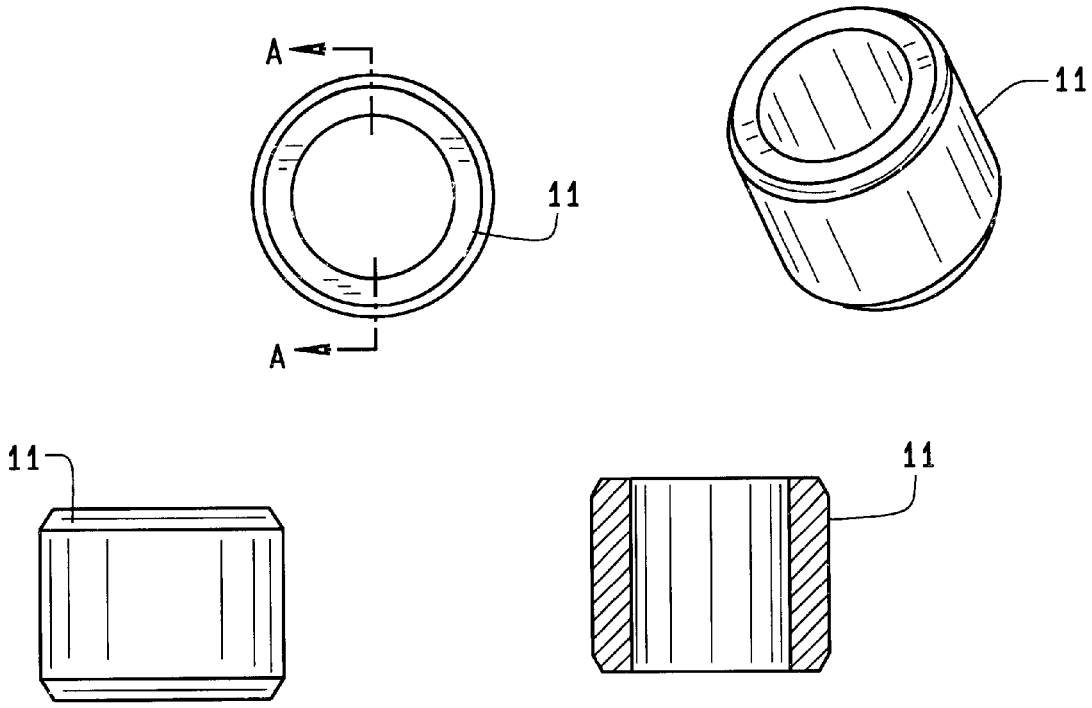
FIG. 5 is a view of one of the sleeve type locking devices for use for securement of the column within its associated spider.

As can be seen in FIG. 2, the column 5 locates within the arranged and aligned counter bore 6, at its upper edge, and the recess 7 formed adjacent the counter bore, includes a locking device, such as the threaded set screw 8, so that as the upper edge of the column 5 is forced within its respective counter bore, during tightening of the rod 2 by means of the flange nut 4, the outer surface of the column 5 binds against the threads of the set screw 8, to provide for a fastening or binding of these two components together, during their forceful assembly. In addition, as can be seen in FIG. 3, an alternative style of locking device may be used. In this instance, it may comprise a sleeve type of locking device as shown at 11. See also FIG. 5. This particular sleeve fits within the recess 7, and is generally formed of some type of malleable material, which may comprise a softer metal, such as lead, aluminum, or the like, or perhaps may even be formed of a polymer, and into which the upper edge 9 of the column can imbed as it is forced into its corresponding counter bore 6, formed into the under side of the spider 1, as noted. Or, in the alternative, the locking device 11 may be formed as a semi-circular type of sleeve, comprising approximately slightly greater than one half of the sleeve 11, as noted in FIG. 5, wherein the outer edges of the semi-circular sleeve slightly protrude into the counter bore 6, and tightly bind against the outer surface approximate the upper edge of the column 5, to hold the same snugly and tightly within the spider 1, during assembly, as previously described.

The purpose of the locking device is generally to provide means for assisting in the retention of the column within the spider counter bore, as previously described, and also, because of a binding of the locking device against either the inner or outer surface of the steel column, once the column has been inserted and applied, the locking device prevents the column from turning, and assures that the table leg will not turn after being properly installed upon the under surface of the table top surface, in combination with its retention spider 1.

Figure 6:
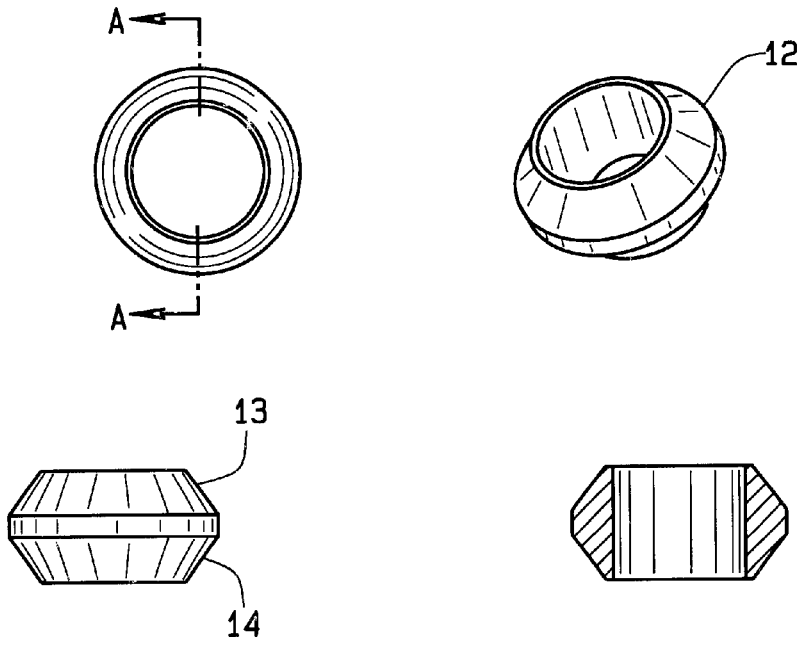
FIG. 6 is a view of a modified type of sleeve type locking device for securement of the column within its associated spider.

Another type of sleeve locking device is shown in FIG. 6, which comprises a slightly shallower type of sleeve 12. The significant upper and lower bevels 13 and 14 provided upon the shown sleeve facilitate its insertion into the recess 7, during installation, and likewise allow for guidance of the upper edge of the column 9, into the counter bore, as it binds or imbeds within the sleeve 12, upon tightening of the flange nut 4 upon its rod 2, during assembly of the table components.

Thus, the essence of this invention is to provide means for both centering and maintaining a concentric relationship between the cylinder 5, in conjunction with its supporting and holding rod 2, when it is tightened within its respective counter bore 7, during assembly of the table legs. Then, the entire combination may be tightly secured to the underside of the table surface, through application of fasteners (not shown), through the spider apertures 11, for final assembly.

Variations, or modifications, to the subject matter of this invention may occur to those skilled in the art upon reviewing of the summary as provided herein, and after undertaking a study of the description of its preferred embodiment, in view of the illustrative drawings. The description of the preferred embodiment as provided herein, is set forth for illustrative purposes only, and is not meant to be limiting of the scope of the invention as described for this table supporting structure.

Having thus described the invention, what is claimed and desired to be secured by Letters Patent is:

1. A table spider column connection for use for supporting a table top surface above its base, said spider column connection being of the type that secures to the bottom of the table top surface, a column for supporting said table top surface upon its base, said column having an opening interiorly thereof and extending its full height, a rod extending through the column securing to the base, and a spider, to tighten the column into its table top surface supporting position, said spider connecting to the bottom of the table top surface, said spider having a downwardly extending groove formed therein, for accommodating the upper end of the column which inserts within the groove during support of the table top surface, locking means provided for insertion within the spider, adjacent its formed downwardly extending groove, and provided for binding against the upper edge of the column to secure it in position within the spider for supporting the table top surface.

2. The table spider column connection of claim 1 wherein said locking means for securing the column to the spider includes a set screw.

3. The table spider column connection of claim 1 wherein said locking means for securing the column to the spider comprising a sleeve type locking device.

4. The table spider column connection of claim 3 wherein said sleeve type of locking device has bevels at its upper and lower surfaces.

5. The table spider column connection of claim 1 wherein said spider includes a series of downwardly directed grooves, concentrically arranged, formed upon the bottom surface of the spider, whereby said grooves are provided for accommodating columns of differing sized diameters, for supporting the table top surface when the table is erected.

6. The table spider column connection of claim 1 wherein said rod threadedly engages within the spider, and said rod threadedly engages at its other end into the table base.

* * * * *

UNITED STATES PATENT AND TRADEMARK OFFICE

CERTIFICATE OF CORRECTION

PATENT NO. : 6,447,199 B1 
DATED : September 10, 2002
INVENTOR(S) : Richard O. Bercowitz, Elliott W. Baum, Lucian N. Chirea and Robert J. Harrell It is certified that error appears in the above-identified patent and that said Letters Patent is hereby corrected as shown below:

Title page,
Item [73], Assignee: "Berod Tableworks Ltd." should actually read:
Assignee: -- Berco Tableworks Ltd. --

Signed and Sealed this

Thirty-first Day of December, 2002

JAMES E. ROGAN
*Director of the United States Patent and Trademark Office*